United States Patent [19]

Bronnert

[11] Patent Number: 4,884,629

[45] Date of Patent: Dec. 5, 1989

[54] HIGH PRESSURE MULTIPLE TUBE AND SHELL TYPE HEAT EXCHANGER

[76] Inventor: Hervé X. Bronnert, 21495 Partridge Ct., Brookfield, Wis. 53005

[21] Appl. No.: 154,359

[22] Filed: Feb. 10, 1988

[51] Int. Cl.[4] ..... F28D 7/00

[52] U.S. Cl. ..... 165/159; 165/82; 29/157.4; 29/463

[58] Field of Search ..... 29/157.4, 157.3 C, 463, 29/523; 165/158, 159, 173, 157, 162, 161, 82, 143; 285/179, 382.2, 382.4, 382.5

[56] References Cited

U.S. PATENT DOCUMENTS

| | | | |
|---|---|---|---|
| 1,511,836 | 10/1924 | Muhleisen | 165/82 |
| 2,026,954 | 1/1936 | Van Dusen | 285/179 |
| 2,075,511 | 3/1937 | De Baufre | 165/82 |
| 2,612,350 | 9/1952 | Stadler | 165/82 |
| 4,152,818 | 5/1979 | Most et al. | 29/157.4 |
| 4,200,145 | 9/1980 | Underwood | 165/143 |

FOREIGN PATENT DOCUMENTS

| | | | |
|---|---|---|---|
| 1022735 | 12/1952 | France | 165/159 |

*Primary Examiner*—Noah P. Kamen

*Attorney, Agent, or Firm*—Foley & Lardner

[57] ABSTRACT

A high pressure, multi-tube and sheet-type heat exchanger including a U-shaped jacket formed from a pair of elongate tubular sections, a fluid medium inlet disposed adjacent one end of one of the tubular sections and a fluid medium outlet disposed adjacent one end of the other tubular section, and a pair of U-shaped semicircular half sections connecting the other ends of the tubular sections, a plurality of one-piece U-shaped tubes of heat conductive material arranged in parallel-spaced relation within the jacket through which the high pressure product flows and a tube sheet mounted on the end of each tubular section, each tube sheet being provided with a plurality of openings corresponding to the number of tubes in the jacket, the tube ends being aligned in the openings in the tube sheets and sealingly affixed thereto either by welding or by press fitting a tubular insert into the open end of the tubes.

9 Claims, 2 Drawing Sheets

HIGH PRESSURE MULTIPLE TUBE AND SHELL TYPE HEAT EXCHANGER

BACKGROUND OF THE INVENTION

The utilization of multiple tube and shell type heat exchangers for the heating or cooling of liquid products is well known; however, where the product is flowing through the tubes in such an exchanger under high pressures, one or more of the following problems have been encountered:

(a) Maintaining proper sealing of the high pressure tubes to maintain the product and the heat exchange medium separate while both are flowing through the exchanger;

(b) Compensating for the expansion and contraction of the tubes;

(c) Relatively short lengths of tubular sections are required to minimize the expansion or contraction effect and thus, necessitates an inordinate number of welded connections between the sections as well as between the tubes and the shell thereby significantly increasing the installation and maintenance costs.

SUMMARY OF THE INVENTION

The heat exchanger according to the present invention includes a number of U-shaped, one-piece tubular members of heat conductive material which are mounted in a correspondingly shaped jacket which includes two elongated tubular sections and a pair of 180-degree half elbows, which are attached to the ends of the tubular jacket sections to form the "U." One section is initially secured to each of the tubular sections and the U-shaped tubes are aligned in a jacket by a spacer which allows for accurate positioning of the tubular members before the jacket is closed. The corresponding ends of the jacket sections are provided with tube sheets having openings in which the ends of the tubular members are positioned. The ends of the tubular members are either welded in the openings or press-fitted into the opening to form an aseptic seal.

A principal feature of the invention is the provision of unitary or one-piece high pressure tubes of U-shape, mounted in a U-shaped jacket and press-fitted into the tube sheets at the ends of the U-shaped jacket. This construction is simpler than known constructions and provides a more effective heat exchange system.

A further feature of the invention is the provision of a high pressure heat exchanger having no welds in the high pressure tubes whereby the high cost of welds is eliminated. This type of construction avoids welds which would induce corrosion weaknesses. It eliminates the need to check for leaks within the heat exchange jacket.

A further feature is the provision of a U-shaped jacket having two-piece, 180 degree U-shaped turn sections, which allows for the visual positioning of the U-shaped tubular members within the jacket with the tube members evenly spaced in the U-shaped jacket.

DETAILED DESCRIPTION OF THE INVENTION

Figure 1:
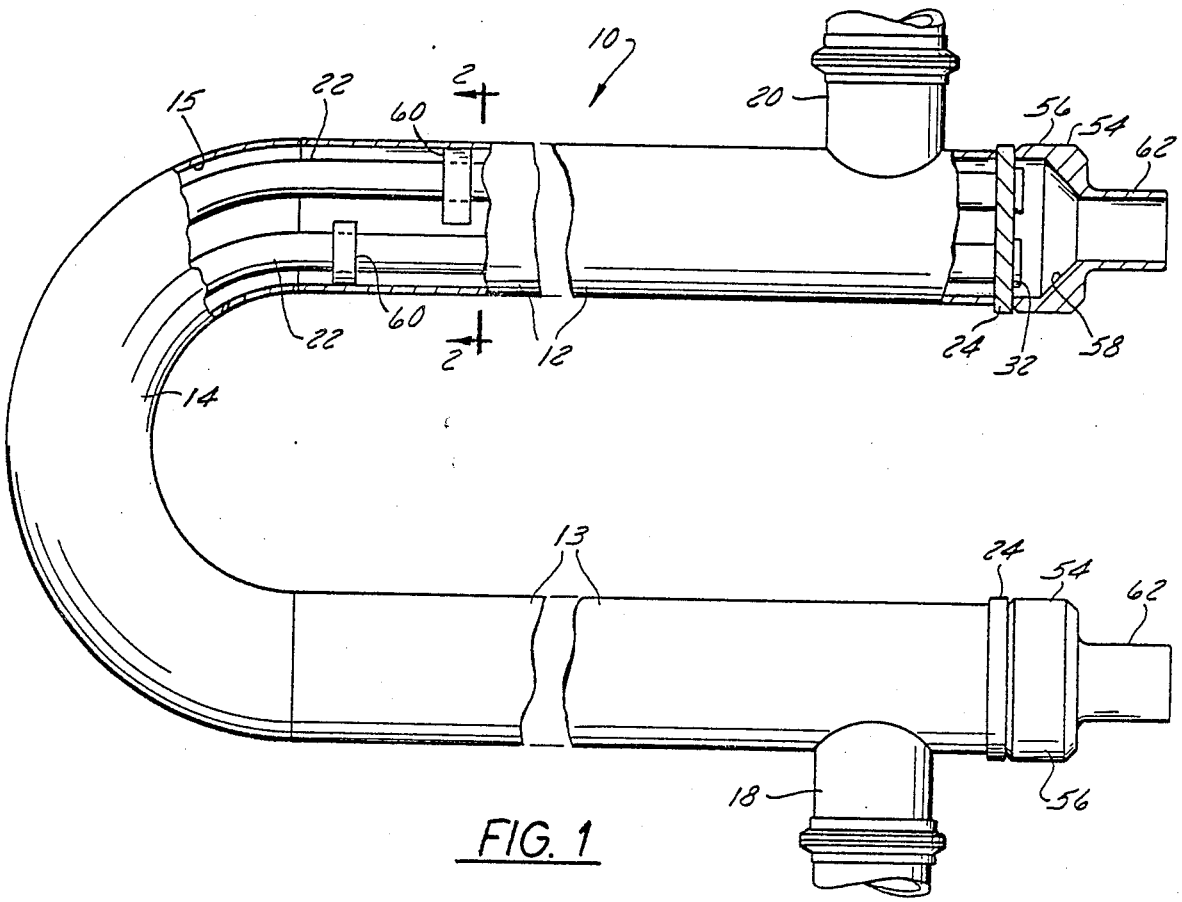
FIG. 1 is a side elevation view of the high pressure multiple tube heat exchanger having one of the U-shaped jacket sections removed and a portion of the tubular member broken away to show the spacing of the U-shaped ends of the tubular members within the jacket.
Figure 2:
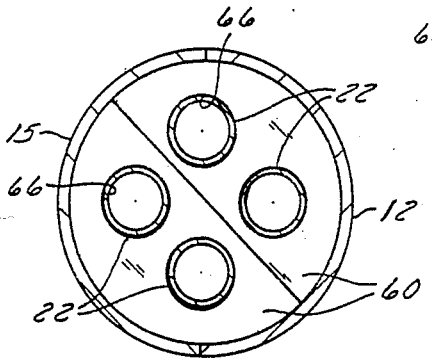
FIG. 2 is a view taken on line 2—2 of FIG. 1 showing the spacing of the tubes within the jacket sections.

Referring to FIG. 1 of the drawing, a preferred embodiment of the improved high pressure, multiple tube and shell-type heat exchanger 10 is shown, which is particularly suitable for use in dairy processing plants and the like for heating or cooling milk. The heat exchanger 10 is not limited for use in dairy processing plants, but may be utilized anywhere where a liquid product flowing under high pressure and at a high velocity is to be heated or cooled by a high temperature medium within a jacket.

Heat exchanger 10 as shown in the drawings includes a jacket or shell of a substantially U-shape and having elongated tubular leg sections 12 and 13 arranged in a substantially parallel relation. The leg sections 12 and 13 are interconnected by a pair of U-shaped, 180-degree half elbows 14 and 15 to form the U-shaped jacket. The jacket is of tubular design with the length of each leg section 12, 13 varying depending on factors such as heat exchange tube length availability and the space limitations where an exchanger is to be located. The jacket may be supported by any conventional frame members which are normally disposed either vertically or horizontally relative to one another.

Means are provided at each end of the leg sections 12 and 13 in the form of an inlet 18 and an outlet 20 for permitting a heat exchange medium to circulate under a pressure of 0 to 400 psig and at a velocity of 0 to 10 feet per second through the jacket interior in a manner to be described more fully hereinafter. The inlet 18 is connected to a suitable source of pressurized heat exchange medium not shown and the outlet 20 is connected to an adjacent heat exchanger jacket if more than one is required in the system or to piping connected to the heat source.

Disposed within the interior of the jacket are a plurality of tubular members 22 formed of heat-conductive material and preferably of uniform cross-section and arranged in a predetermined, relatively spaced, substantially parallel relation. The number, size, arrangement and cross-sectional shape of the tubular members 22 may vary from that shown, if desired. A normal dimensional range of the size of the tubular members 22 is ½ to 1 inch outside diameter when the jacket sections have a dimensional range of 1½ to 4 inches outside diameter. An important feature of the tubular member 22 is that they are of continuous construction from end to end so that there are no welds required in the high pressure tubular members in the heat exchanger.

The tubular members should be arranged such that each tubular member is spaced from the interior surface of the jacket and the exterior of adjacent tubular members so that the entire exterior of each member will be in contact with the heat exchange medium as it circulates through the jacket interior and, thus, effect a superior rate of heat exchange between the product flowing through the tubular member 22 and the circulating medium.

Figure 4:
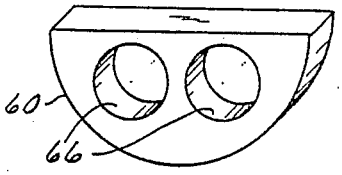
FIG. 4 is a perspective view of one of the tube baffles.
Figure 3:
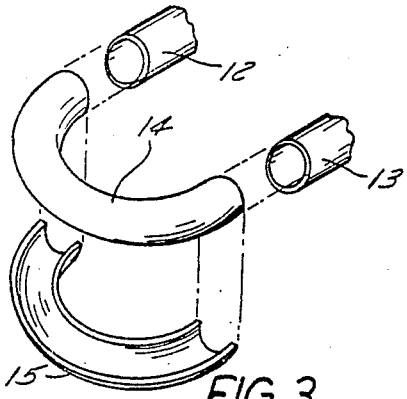
FIG. 3 is an exploded view of the end of the U-shaped jacket, showing the two 180-degree, half sections.

The tubular members 22 are spaced within the jacket by means of baffles 60. Each baffle 60 as shown in FIG. 4 has a substantially semi-circular configuration and a pair of openings 66 of substantially the same diameter as tubular members 22. The baffles 60 are mounted on the tubular members 22 in a perpendicular relation to the axis of the tubes and jacket. Successive baffles 60 are rotated substantially 180 degrees about the jacket axis as shown in FIG. 1. The curved outer periphery of each baffle 60 conforms substantially to the curvature of the interior of the jacket sections. The baffles 60 are provided in the tubular leg sections 12 and 13, only. The baffles 60 co-act with one another and the jacket interior surface to maintain the tubular members 22 in a predetermined, relatively spaced, substantially parallel relation throughout the length of the jacket sections. Each baffle 60 is frictionally retained in a selected position within the jacket sections and will move slightly with respect to the jacket interior surface to compensate for any expansion or contraction of the tubular member 22 when the heat exchanger is in an operational mode. The number of baffles 60 to be used will depend upon the length of the tubular leg sections 12, 13. Rotating of successive baffles 180° facilitates circulation of the heat exchange medium throughout the jacket without portions of the medium becoming trapped between successive elements. In addition to supporting the tubular members, the baffles 60 function to cause the medium flow to become turbulant. There are no baffles in the U-shaped sections 14, 15 of the jacket to allow the U-shaped end of the tubular members 22 to expand and contract within the jacket.

The ends of the jacket sections 12 and 13 are closed by means of tube sheets 24 which are welded to the open ends of the jacket sections 12 and 13. Each of the tube sheets 24 includes a number of openings 26 corresponding to the number of tubular members 22 which are to be provided within the jacket. Although only four tubes are shown in the drawings, any number of tubes can be used within the practical limits of the jackets.

Figure 5:
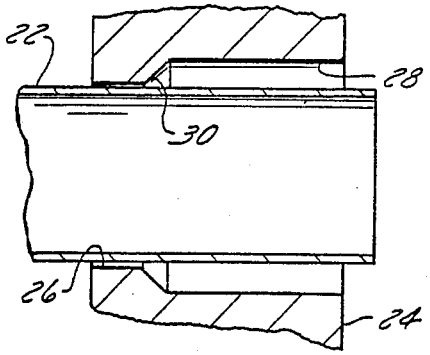
FIG. 5 is a cross-sectional view of a portion of the tube sheet showing one of the tube ends positioned in the opening in the tube sheet at the end of the jacket.
Figure 6:
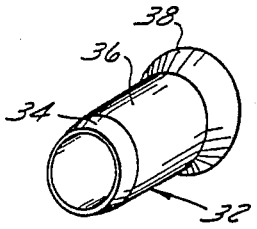
FIG. 6 is a perspective view of a tubular insert.
Figure 7:
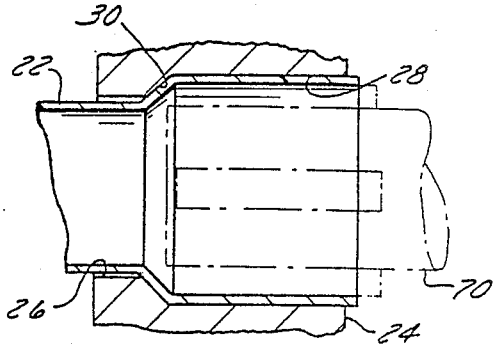
FIG. 7 is a cross-sectional view of a portion of the tube sheet showing the tube end expanded in the opening of the tube sheet.
Figure 8:
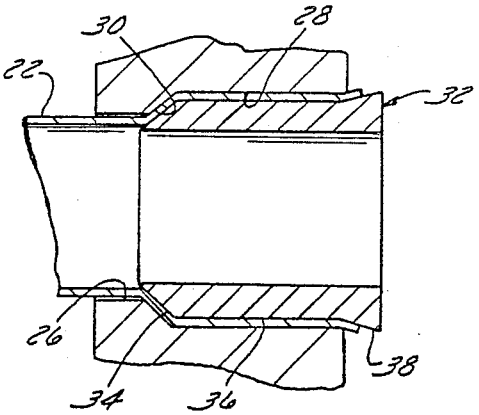
FIG. 8 is a view of a portion of the tube sheet showing the end of the tube with the tube seal insert wedged in the end of the tube to form an aseptic seal.

In this regard and referring to FIGS. 5, 7 and 8, a portion of one of the tube sheets 24 is shown having an opening 26 and a counterbore 28 connected to the opening 26 by means of a conical section 30. In FIG. 5, the end of one of the tubular member 22 is shown positioned in the opening 26 with the end of the tube 22 aligned with the end of the counterbore 28. As seen in FIG. 7, the end of the tube 22 in the counterbore 28 has been expanded to conform to the shape of the counterbore 28 by any conventional rotary tube expander as shown in phantom in FIG. 6. The end of the tube 22 is sealed in the counterbore 28 by means of a tube seal insert 32 as shown in FIG. 6.

In this regard, the insert 32 is formed from a tubular member having an inside diameter corresponding to the diameter of the tubular member 22. The outside of the tubular member is provided with a conical end section 34, a tubular midsection 36 and a head 38. The diameter of the midsection 36 corresponds to the diameter of the counterbore 28 less the thickness of the tubular member 22 so that the insert fits tightly into the end of tubular member 22 in the counterbore 28 as shown in FIG. 8.

The inert 32 is press-fitted into the counterbore 28 to form an aseptic seal between the end of the tubular member 22 and the counterbore 28. With this arrangement, there are no welds in the tubular members which would be exposed to the high pressure product.

Figure 9:
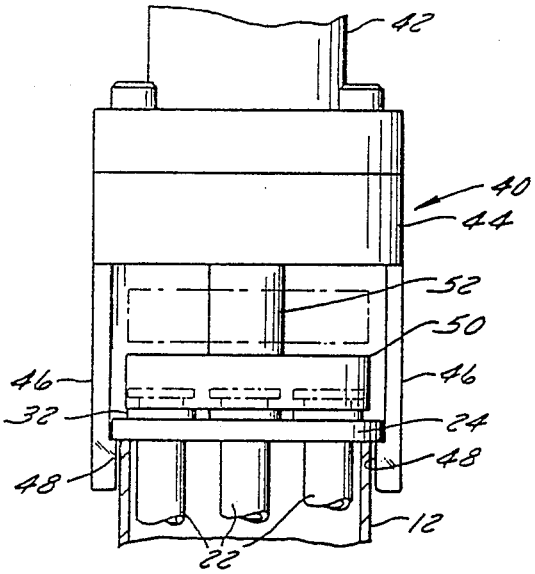
FIG. 9 is a view partly broken away showing the piston drive assembly for wedging the inserts into the expanded ends of the tubular members in the openings in the tube sheet.

The inserts 32 are forced into the ends of the tubular members 22 by means of a press 40 as shown in FIG. 9. The press 40 can be either of the hydraulic or pneumatic type. The press 40 includes a cylindrical housing 42 secured to a mounting bracket 44 having a pair of attachment arms 46. The attachment arms 46 are spaced a distance apart equal to the diameter of the tube sheet 24 and includes stops 48 at the lower ends for engaging the edge of the tube sheet 24. The inserts are forced into the ends of the tubular members 22 by force or by means of the press 40 which includes a plate 50 mounted on the end of a piston rod 52 that is secured to a piston head (not shown) in the cylinder 42. The inserts 32 are initially aligned in the ends of the tubular members 22 and the press 40 mounted on the edges of tube sheet 24. On actuation of the piston, the plate 50 will bear against the head 38 of the inserts 33, forcing them into the end tubular members 22 until the end of the insert has pressed the tubular member against the conical section 30 to form a press-fit with the counterbore 28.

It should be noted that only the ends of the tubular members 22 are secured to the tube sheets 24 and the spacers 60 are frictionally retained within the jacket so that expansion and contraction of the tubular members are not inhibited and, thus, the connection between the tubular members and the tube sheets and the connection of the tube sheets to the jacket ends are not adversely affected. It should be noted that no seals or gaskets are utilized at these connections, thus, significantly reducing the cost of installation and maintenance.

Figure 10:
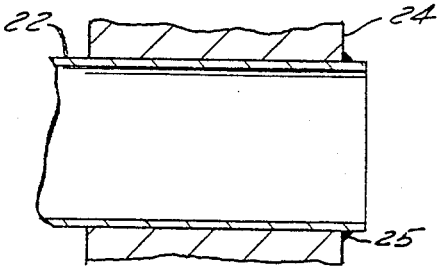
FIG. 10 is a cross-sectional view of a tube sheet having a tube end welded in the opening. Other features and advantages of the invention will become apparent to those skilled in the art upon review of the following detailed descriptions, claims, and drawings. Before one embodiment of the invention is explained in detail, it is to be understood that the invention is not limited in its application to the details of construction, any arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Referring to FIG. 10 an alternate method of securing the ends of the tubular members 22 to the tube sheet 24*a*. In this arrangement, the tube sheet 24*a* is provided with openings 26*a*. The ends of the tubes 22 are inserted therein and sealingly affixed to the tube sheet by weld 25 provided between the end of the members 22 and the opening 26 in the tube sheet.

The ends of the jacket are closed by means of adapter pieces 54 which are mounted on the edges of the tube sheets 24. Each adapter piece 54 is provided with an enlarged collar 56 which abuts the rim portion of the tube sheet 24. The interior surface of the collar 56 includes a tapered section 58 which communicates with a reduced diameter end section 62. The inside dimension of the end section 62 is substantially equal to the sum of the inside dimensions of the tubular members 22.

When a single loop heat exchanger is required, the adapter pieces are connected directly to the piping utilized in interconnecting various components of a fluid processing system. If two or more U-shaped heat exchangers are required, the end pieces on the jackets sections 12 and 13 are connected in series , and the end sections 62 on adjacent heat exchangers are connected by a U-shaped tube having a diameter corresponding to the inside diameter of the end section 62.

The embodiments of the invention in which an exclusive property or privilege is claimed, are defined as follows:

1. A high pressure, multiple-tube and shell-type heat exchanger comprising a substantially U-shaped jacket having a heat exchange medium inlet disposed adjacent one end thereof and a heat exchange medium outlet disposed adjacent a second end thereof, said jacket being formed of two elongate tubular sections and an identical pair of semi-circular arcuate members sealingly affixed to one end of each of said tubular sections and to each other to form a sealed U-shaped jacket, a plurality of tubes of heat conductive material arranged in relatively spaced, substantially parallel relation and disposed within said jacket and through which a high pressure product flows, each tube being a continuous, one-piece tube and having a substantially U-shape conforming substantially to the U-shape of the jacket, and a tube sheet fixedly sealingly mounted on said end of said jacket, each tube sheet being provided with a plurality of openings aligned with corresponding ends of said tubes, said corresponding ends being aligned in said openings in said tube sheets and sealingly affixed thereto.

2. The heat exchanger, according to claim 1, including a plurality of baffles disposed within said jacket and frictionally engaging the interior of said jacket and being secured to the exterior of said tubes for maintaining said tubes in said relatively spaced, parallel relation without inhibiting expansion and contraction of said tubes relative to said jacket.

3. The heat exchanger, according to claim 1, wherein the mounting of said tube sheets to said jacket ends and the mounting of the ends of said tubular members to said tube sheets are gasket free.

4. A heat exchanger, according to claim 1, including a tubular insert having an internal diameter corresponding to the internal diameter of said tubes and being press fitted into the end of each of said tubes to seal said ends in the openings in said tube sheets whereby no cracks will be present between the inserts, the tubes and the tube sheet.

5. A shell-type heat exchanger comprising a substantially U-shaped jacket having a heat exchange medium inlet disposed adjacent one end thereof and a heat exchange medium outlet disposed adjacent the other end thereof, said jacket including a pair of elongate tubular sections, and an identical pair of "U" shaped 180° curved sections connected to one end of each of said elongate sections to form a continuous flow path through said jacket, one or more tubular members of heat conductive material arranged in relatively spaced substantially parallel relation to said jacket and through which a high pressure product flows, each tubular member being a continuous, one piece tube, a tube sheet fixedly and sealingly mounted on said end of said jacket, each tube sheet being provided with an opening for the end of each of said tubular members mounted in said jacket, means for sealingly affixing said end of each tubular member in a said opening in said tube sheet and a number of semi-circular baffles mounted on said tubes and frictionally engaging said elongate sections for maintaining said tubular members in a parallel-spaced relation whereby the U-shaped tubes are free to expand and contract in said U-shaped curve sections of said jacket.

6. The heat exchanger according to claim 5 wherein said openings in said tube sheets include a counterbore, said tube ends being expanded into said counterbore and a tubular insert press-fitted into each of said ends of said tubular members to sealingly affix the ends of said tubular members to said counterbore, said insert having an external diameter corresponding to the internal diameter of said tubular members to provide an unobstructed flow path through said tubular members.

7. The heat exchanger according to claim 5 wherein said affixing means comprises a weld for sealing the end of the tube to the tube sheet.

8. A method for assembling a high pressure multi-tube and shell-type heat exchanger comprising the steps of forming a pair of elongate tubular jacket sections of equal length and diameter, securing a tube sheet to one end of each tubular section, each tube sheet having a number of openings, forming an identical pair of U-shaped semicircular jacket sections, securing one of said U-shaped jacket sections to the other ends of said tubular jacket sections, forming a number of one piece, U-shaped, tubular members corresponding to the member of openings in said tube sheets, inserting the ends of the tubular members into the elongate jacket sections until the ends of the tubular members are aligned in the openings in the tube sheets, sealingly affixing the ends of the tubular members in the openings in the tube sheets and securing the other of said U-shaped jacket sections to the other ends of said elongate jacket sections and to the said one U-shaped jacket section to form a closed jacket around the U-shaped tubular members.

9. The method according to claim 8, including the step of mounting a number of semicircular baffles on said tubular members prior to inserting the tubular members in said elongate jacket sections to align said tubular members in a parallel spaced relation in said elongate jacket sections.

* * * * *

UNITED STATES PATENT AND TRADEMARK OFFICE

CERTIFICATE OF CORRECTION

PATENT NO. : 4,884,629

DATED : December 5, 1989

INVENTOR(S) : Herve X. Bronnert

It is certified that error appears in the above—identified patent and that said Letters Patent is hereby corrected as shown below:

Col, 6, line 47, change "member" to -- number -- .

Signed and Sealed this

Twenty-second Day of January, 1991

*Attest:*

HARRY F. MANBECK, JR.

*Attesting Officer*

*Commissioner of Patents and Trademarks*